United States Patent [19]

Monbaliu et al.

[11] 4,201,584

[45] May 6, 1980

[54] SILVER HALIDE ELEMENTS CONTAINING YELLOW FORMING COLOR COUPLERS FOR SILVER HALIDE PHOTOGRAPHY

[75] Inventors: Marcel J. Monbaliu, Mortsel; Raphaël K. Van Poucke, Berchem, both of Belgium

[73] Assignee: AGFA-GEVAERT N.V., Mortsel, Belgium

[21] Appl. No.: 943,863

[22] Filed: Sep. 19, 1978

[30] Foreign Application Priority Data

Oct. 7, 1977 [GB] United Kingdom ..... 41834/77

[51] Int. Cl.[2] ..... G03C 7/00; G03C 1/40

[52] U.S. Cl. ..... 430/389; 430/467; 430/472; 430/566

[58] Field of Search ..... 96/55, 100 R, 100 N

[56] References Cited

U.S. PATENT DOCUMENTS

| | | | |
|---|---|---|---|
| 3,510,306 | 5/1970 | Yoshida et al. | 96/55 |
| 3,966,475 | 6/1976 | Van Poucke et al. | 96/55 |
| 4,032,347 | 6/1977 | Van Poucke et al. | 96/100 N |
| 4,049,458 | 9/1977 | Boie et al. | 96/100 N |
| 4,095,983 | 6/1978 | Wolff et al. | 96/100 N |
| 4,106,942 | 8/1978 | Tanaka et al. | 96/55 |

FOREIGN PATENT DOCUMENTS

| | | | |
|---|---|---|---|
| 2114577 | 10/1972 | Fed. Rep. of Germany | 96/100 R |

*Primary Examiner*—J. Travis Brown
*Attorney, Agent, or Firm*—A. W. Breiner

[57] ABSTRACT

Novel color forming couplers for use in silver halide color photography are described. These couplers upon oxidative coupling with an aromatic primary amino color developing agent produce dyes of improved stability against light and dyes having favorable spectral absorption characteristics. The couplers have high coupling activity and thus produce high color densities.

The novel couplers are acylacetanilide compounds whereof the phenyl nucleus of the anilide group carries oxyhydrocarbon groups, preferably alkoxy groups in the 2-, 4- and 5-position with respect to the amido group.

8 Claims, No Drawings

SILVER HALIDE ELEMENTS CONTAINING YELLOW FORMING COLOR COUPLERS FOR SILVER HALIDE PHOTOGRAPHY

The present invention relates to novel yellow forming couplers for use in the production of photographic colour images and to light-sensitive silver halide colour elements comprising such couplers.

It is known that for the production of a photographic colour image in a light-sensitive silver halide layer, the exposed silver halide is developed to a silver image by means of an aromatic primary amino developing agent in the presence of a colour forming coupler which reacts with the oxidized developing substance to form a dyestuff image at the areas corresponding to the silver image.

In the subtractive three-colour photography a light-sensitive photographic colour material is used containing red-sensitized, green-sensitized and blue-sensitive silver halide emulsion layers wherein on colour development cyan, magenta and yellow dyestuff images are formed respectively.

The colour forming couplers may be of the diffusible type or of the non-diffusible type. By diffusible couplers is meant colour forming couplers, the dispersability or solubility of which is sufficient to enable them to be usefully incorporated in aqueous colour processing liquids e.g. developing solutions, whereas by non-diffusible colour forming couplers is meant colour forming couplers containing a ballasting group intended for incorporation in the photographic element wherein they should remain during processing.

It is common practice to use for the formation of the cyan dye image phenol or naphthol couplers, for the formation of the magenta dye image 2-pyrazolin-5-one couplers and for the formation of the yellow dye image ketomethylene couplers containing a methylene group having two carbonyl groups attached to it.

It is also known to employ besides colour forming couplers wherein the coupling position is unsubstituted, thus requiring for the formation of one molecule of dyestuff the development of four molecules of exposed silver halide, colour forming couplers wherein the coupling position carries a substituent that is split off upon colour development so that only two exposed silver halide molecules should be developed to form one molecule of dyestuff. The former compounds are known as 4-equivalent couplers whereas the latter are known as 2-equivalent couplers.

The principal advantages of 2-equivalent couplers are known. They require approximately half as much silver halide as the 4-equivalent couplers so that in the preparation of the silver halide elements less silver halide can be used and thinner emulsion layers can be employed, which results in improved resolution and sharpness. Some groups which are split off inhibit development, and couplers containing such groups are known as DIR-couplers (Development Inhibitor Releasing couplers) or ICC-couplers (Interlayer Colour Correction couplers).

Photographic colour forming couplers often produce deficiencies whereof the important ones are that the dyestuff images formed upon colour processing, easily fade out under the influence of light, heat or humidity that the dyestuff colour separation images show undesirable side-absorption in the absorption region of the other dyestuff colour separation image(s) so that the colour of the dyestuff images is impaired and that the dyestuff images have too low a density which is due to poor coupling activity of the colour forming couplers.

In the U.S. Pat. No. 3,843,366 2- and 4-equivalent yellow forming ketomethylene couplers are described yielding yellow dyes with little side absorption in the green part of the electromagnetic wavelength range. The colour forming couplers according to U.S. Pat. No. 3,843,366 are benzoylacetanilides of which both the phenyl nucleus of the benzoyl and of the anilide group comprise an ortho alkoxy substituent. The phenyl nucleus of the anilide group further carries in the 4-position an alkoxy carbonyl, a sulphamoyl group or an alkylsulphonyl.

From the published German Pat. application DE-OS No. 2,114,577 2- and 4-equivalent acylacetanilide yellow colour formers are known the anilide group of which is a 2,5-dialkoxy anilide group or a 2,5-dialkoxy-4-chloroanilide group.

In the U.S. Pat. No. 4,032,347 2-equivalent ketomethylene yellow forming couplers are described which are easy to prepare and have a high coupling activity. These colour forming couplers whereof the active methylene carries a 2,6-dioxo-7-purinyl group, include pivaloylacetanilides and benzoylacetanilides, the phenyl nucleus of anilide group of which may be substituted with one or more of a large variety of groups. The specific examples include acylacetanilides with 2,4- or 2,5-dialkoxyanilide group and 2,5-dialkoxy-4-sulphamoyl anilide group.

From the U.S. Pat. No. 3,966,475 acylacetanilide yellow forming couplers are known that comprise in the phenyl nucleus of the anilide group, besides the characterizing 4-aryloxysulphonyl group also 2,5-dialkoxy groups.

In accordance with the present invention novel 2- and 4-equivalent acylacetanilide yellow forming couplers are provided, which yield upon colour development by means of an aromatic primary amino colour developing agent, yellow dyestuff images with improved stability against light. Moreover these colour forming couplers have high coupling activity and produce dyes with high colour density and favourable spectral absorption characteristics.

The yellow colour forming couplers of the present invention are acylacetanilide couplers preferably benzoylacetanilide and pivaloylacetanilide couplers that are characterized in that the phenyl nucleus of the anilide group of the molecule carries oxyhydrocarbon groups preferably alkoxy groups in the 2-, 4- and 5-position with respect to the amido group.

More particularly, the acylacetanilide colour couplers of the present invention are acylacetanilides wherein the phenyl group of the anilide part of the molecule contains relative to the amide link in the 5-position a lower ($C_1$–$C_5$) alkoxy group, and in the 2- and 4-positions an alkoxy group including a substituted alkoxy group or an aryloxy group including a substituted aryloxy group, at least one of the 2- and 4-positions carrying a lower ($C_1$–$C_5$) alkoxy group.

The couplers of the present invention yield upon colour development dyes of better stability against light than the known acylacetanilides the anilide group of which carries 2,5-dialkoxy-substituents and no substituent or an electronegative substituent e.g. chlorine, sulphamoyl, acylamino, etc. in the 4-position.

They often show higher coupling activity than the corresponding dialkoxy compounds.

Preferred acylacetanilide yellow forming couplers according to the present invention can be represented by the following general formula:

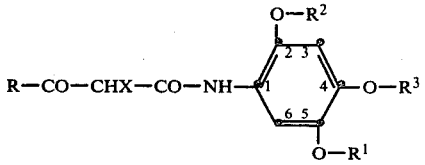

wherein R represents alkyl e.g. t-butyl or phenyl including substituted phenyl e.g. phenyl substituted with halogen, $C_1$–$C_{20}$ alkoxy e.g. methoxy, hexadecyloxy, including substituted $C_1$–$C_{20}$ alkoxy e.g. halogen substituted alkoxy, acylamino and sulphamoyl or carbamoyl including substituted sulphamoyl and carbamoyl, $R^1$ is $C_1$–$C_5$ alkyl, preferably methyl or ethyl, each of $R^2$ and $R^3$ may represent a $C_1$–$C_{20}$ alkyl group including a $C_1$–$C_{20}$ substituted alkyl group e.g. aralkyl, alkoxyalkyl, alkylthioalkyl and aryloxyalkyl, an aryl group including a substituted aryl group e.g. alkylaryl and alkoxyaryl, at least one of $R^2$ and $R^3$ being lower ($C_1$–$C_5$) alkyl and more particularly methyl or ethyl as defined for $R^1$, X represents a hydrogen atom or a substituent that exhibits two equivalent character on colour development e.g. a halogen atom e.g. chlorine and fluorine as described e.g. in French Pat. No. 991,453 and 869,169, in U.S. Pat. No. 2,728,658 and 3,277,155 and in the published German Pat. Application DE-OS 2,114,577; a S—R′ group wherein R′ is alkyl, substituted alkyl, aryl substituted aryl, a heterocycle or substituted heterocycle as described in U.S. Pat. No. 3,265,506 and British Pat. No. 953,454; a —O—R″ group wherein R″ represents alkyl, substituted alkyl, aryl, substituted aryl, acyl including substituted acyl e.g. acetyl and benzoyl as described in British Pat. No. 1,092,506, in French Pat. Nos. 1,411,385 and 1,385,696 and in U.S. Pat. Nos. 3,447,928 and 3,408,194; a heterocycle e.g. a 5-pyrazolyl group as described in Belgian Pat. No. 855,116 or a 5- or 6-membered N-containing saturated or unsaturated heterocycle e.g. a benztriazolyl group as described in the published German Patent Application DE-OS No. 1,800,402, an imidazolyl group, a 7-theophyllinyl group as described in U.S. Pat. No. 4,032,347 and a variety of groups described in the published German Patent Applications DE-OS Nos. 2,057,941; 2,163,812; 2,213,461; 2,318,807; 2,329,587; 2,363,675; 2,414,006 and 2,433,812, in British Pat. No. 638,039 and in U.S. Pat. Nos. 3,253,924; 4,032,347 and 3,930,861.

The acylacetanilide yellow forming colour couplers according to the present invention can be prepared by the following reaction steps: nitration of a 1,2- or 1,4-dialkoxybenzene, e.g. 1,2- or 1,4-dimethoxybenzene to form a 1,2-(1,4)-dialkoxy-4,5-(2,5-)-dinitrobenzene compound, reaction of the latter in the presence of a base with a hydroxy compound e.g. a straight chain or branched chain alcohol or a phenol e.g. methanol, ethanol, butanol, hexadecylalcohol, octadecylalcohol, benzylalcohol, ethylene glycol, ethyleneglycol monomethyl ether, ethylene glycol monophenyl ether, xylene diol, phenol, toluol etc., hydrogenation of the mononitrobenzene compound comprising now three oxyhydrocarbon groups to form an aniline compound bearing three oxyhydrocarbon groups, and reacting this aniline in the known manner with an acylacetic acid ester in order to obtain a 4-equivalent yellow forming coupler. From the 4-equivalent couplers 2-equivalent couplers can be made in the known ways e.g. as described in the patents and published patent applications referred to hereinbefore for the substituent that confers to the colour coupler a 2-equivalent character.

The following is illustrative of the preparation of the intermediate aniline compounds from which colour couplers of the present invention can be made.

(a) Nitration of a 1,2- or 1,4-dialkoxy benzene compound

Preparation of 1,2-dimethoxy-4,5-dinitrobenzene

In a reaction vessel of a capacity of 5 l, 2.07 l (33.4 mole) of nitric acid (sp.g. = 1.42) and 0.855 l (16 mole) of concentrated sulphuric acid were introduced. The reaction mixture was cooled to 10° C. While stirring vigorously, 1 kg (7.25 mole) of 1,2-dimethoxybenzene was added dropwise in 4 hours. The temperature was kept below 20° C. while the benzene derivative was added. The reaction mixture was poured in ice-water (5 kg of ice and 10 l of water) while stirring. The residue which was formed was stirred for 1 h, then collected and washed with water until acid-free. The residue was dried. Yield: 1.52 kg (92%); melting point 129° C. Upon recrystallisation from toluol the melting point was 132° C.

Preparation of 1,4-dimethoxy-2,5-dinitrobenzene

In a reaction vessel of a capacity of 5 l, 1310 ml (14 mole) of acetic acid anhydride were introduced and while stirring 834 ml (20 mole) of fuming nitric acid (sp.gr. 1.52) were added in 1 h. During said addition the reaction temperature was kept below 20° C. Thereupon the mixture was cooled to −10° C. and then 552 g (4 mole) of 1,4-methoxybenzene were added portion-wise in 1 h. During this addition the temperature was kept below −8° C. A yellow precipitate formed. The reaction mixture was stirred for another 2 h at 0° C. Thereafter the mixture was poured in ice-water (10 kg of ice and 10 l of water). The residue was filtered off, the product was stirred in acetone (1 g per 3 ml) and this treatment was repeated three times.

Yield: 320 g (35%); melting point: 202° C.

(b) Reaction of the dialkoxy dinitrobenzene compounds with a hydroxy compound

The following general procedure was followed.

To a solution of 0.1 mole of the phenol or alcohol in dry benzene (6–12 ml of dry benzene per g), 0.1 mole of sodium hydride (or 4.36 g of a 55% by weight suspension of sodium hydride in oil) were added. Hydrogen formed and when said formation had ceased (in about 30 min) the dialkoxy-dinitrobenzene compound was added, whereupon the reaction mixture was refluxed for 1 to 4 h until one of the nitrogroup was completely converted (detected by means of thin layer chromatography). The reaction mixture was washed with water and the benzene layer was evaporated until dryness and the residue was recrystallized from a suitable solvent.

The above general procedure is illustrated as follows.

Preparation of 2-benzyloxy-4,5-dimethoxy-nitrobenzene

To a solution of 259.2 g (248 ml) of benzylalcohol in 3 l of dry benzene, 115.6 g of a 55% by weight suspension in oil of sodium hydride (2.65 mole) were added.

When the formation of hydrogen had ceased (in about 30 min) 456 g (2 mole) of 1,2-dimethoxy-4,5-dinitrobenzene were added and the reaction mixture was refluxed for 2 h. To the solution, 4 l of methanol and 300 ml of water were added. Upon cooling in ice a precipitate was formed which was filtered off and dried. Yield: 369 g (64%); melting point: 141° C.

In a similar way were prepared:

2-hexadecyloxy-4,5-dimethoxynitrobenzene; yield: 12%; melting point: 70° C.;

2-(2',4'-di-t-pentyl-phenyloxy)-4,5-dimethoxynitrobenzene; yield: 50%; melting point: 79° C.;

2-β-(2',4'-di-t-pentyl-phenyloxy)ethyloxy-4,5-dimethoxynitrobenzene; yield: 60%; melting point: 94° C.

Preparation of 2,5-dimethoxy-4-hexadecyloxy nitrobenzene

A mixture of 12.7 g (0.0525 mole) of hexadecylalcohol and 2.50 g of a 55% by weight oily suspension of sodium hydride (0.057 mole) in 100 ml of dimethylformamide was stirred for 1 h at 50° C. (formation of foam). Thereafter 11.4 g (0.05 mole) of 1,4-dimethoxy-2,5-dinitrobenzene prepared as illustrated hereinbefore was added and the mixture was stirred for 1 h at 50° C. The mixture was poured in 500 ml of water and 10 ml of acetic acid. The precipitate which was formed, was filtered off and washed with water, dried and recrystallized from methanol. Yield: 60%; melting point: 71° C.

The dialkoxy dinitrobenzene compounds can also be allowed to react with the hydroxy compounds in the presence of other bases as is illustrated by the following preparation.

Preparation of 2,4,5-trimethoxy-nitrobenzene

A mixture of 68.4 g (0.3 mole) of 1,2-dimethoxy-4,5-dinitrobenzene, prepared as described hereinbefore, in 400 ml of dry benzene and 59.4 ml of a 30% by weight solution in methanol of sodium methylate (0.33 mole), was refluxed for 2 h. The hot benzene solution was washed with water and then cooled. The precipitate formed was filtered off and washed with methanol. Yield: 47.3 g (74%); melting point: 129° C.

(c) Hydrogenation of the nitrobenzene compound

The mononitrocompounds bearing three oxyhydrocarbon groups prepared as described in (b) were dissolved in ethanol or in ethylene glycol monomethyl ether and were catalytically reduced at 70° C. using Raney-nickel as a catalyst.

Said hydrogenation may also occur with iron powder and acetic acid.

The following preparations illustrate this.

Preparation of 2,4,5-trimethoxy-aniline

In an autoclave, having a capacity of 1 l, 190 g (0.89 mole) of 2,4,5-trimethoxy-nitrobenzene, 18 ml of a Raney nickel suspension and 300 ml of ethanol were introduced. Hydrogenation occurred with hydrogen at 70° C. while the pressure was kept within a range of 750 and 1500 psi.

The theoretic amount of hydrogen (2.68 mole) was consumed after agitating the reaction vessel for 1½ h. The catalyst was filtered off while still hot, and 10 ml of hydrazinehydrate was added to the filtrate as antioxidizing agent for the amine. After having been cooled in ice the precipitate was filtered off. Yield: 114 g (70%). Melting point: 93°–95° C.

Preparation of 2-benzyloxy-4,5-dimethoxy-aniline

To a hot suspension (60° C.) of 260 g 2-benzyloxy-4,5-dimethoxy-nitrobenzene in 900 ml of ethanol, 1350 ml of glacial acetic acid and 900 ml of water, 282.6 g of iron powder was added portion-wise over 30 min. Thereafter the mixture was refluxed for ¼ h. The reaction mixture was poured into 10 l of water and the oily product was extracted with dichloromethane. After drying the solvent was evaporated. Yield: 116 g (50%). Melting point: 74° C.

Preparation of 2,5-dimethoxy-4-hexadecyloxy-aniline

In an autoclave 49.5 g (0.117 mole) of 2,5-dimethoxy-4-hexadecyloxy nitrobenzene dissolved in 120 ml of ethanol were hydrogenated using 2.5 ml of Raney-nickel, a hydrogen pressure between 750 and 1500 psi and a temperature of 70° C. After 3 h of agitation the catalyst was filtered off and the filtrate was cooled in ice. The residue formed was filtered off, stirred in ethanol and dried. Yield: 39.5 g (86%). Melting point: 61° C.

In a similar way were prepared:

2-hexadecyloxy-4,5-dimethoxyaniline; yield: 87%; melting point: 58° C.;

2-(2',4'-di-t-pentyl phenyloxy)-4,5-dimethoxyaniline; yield: 84%; melting point: 74° C.;

2-β-(2,4'-di-t-pentyl phenyloxy)ethoxy-4,5-dimethoxyaniline; yield: 63%; melting point: 95° C.

In the following tables A and B representative examples are given of colour couplers according to the present invention which can be prepared as is known in the art and as illustrated hereinafter by reaction of the aniline compound with the appropriate acylacetic acid ester.

Table A

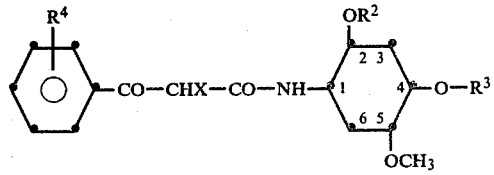

| No. of colour forming coupler | $R^4$ | $R^2$ | $R^3$ | X | Melting point °C. |
|---|---|---|---|---|---|
| 1 | 4-$OCH_3$ | $CH_3$— | $C_{16}H_{33}$— | H | 99 |
| 2 | 4-$OCH_3$ | $CH_3$— | $C_{16}H_{33}$— | Cl | 84 |
| 3 | 4-$OCH_3$ | $CH_3$— | $C_{16}H_{33}$— | T* | 98 |
| 4 | 4-$OC_{16}H_{33}$ | $CH_3$— | $CH_3$— | H | 102 |
| 5 | 4-$OC_{16}H_{33}$ | $CH_3$— | $CH_3$— | Cl | 90 |
| 6 | 4-$OC_{16}H_{33}$ | $CH_3$— | $CH_3$— | T* | 129 |

Table A-continued

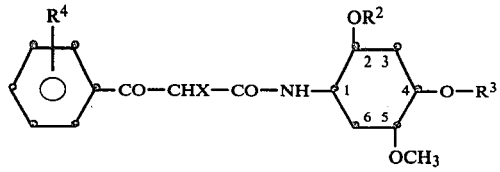

| No. of colour forming coupler | $R^4$ | $R^2$ | $R^3$ | X | Melting point °C. |
|---|---|---|---|---|---|
| 7 | 4-$OC_{16}H_{33}$ | $CH_3$— | $CH_3$— | $OC_6H_4$-4-$COOCH_3$ | 110 |
| 8 | 4-$OC_{16}H_{33}$ | $C_6H_5$—$CH_2$— | $CH_3$— | H | 106 |
| 9 | 4-$OC_{16}H_{33}$ | $C_6H_5$—$CH_2$— | $CH_3$— | Cl | 98 |
| 10 | 4-$OC_{16}H_{33}$ | $C_6H_5$—$CH_2$— | $CH_3$— | T* | 95–103 |
| 11 | 4-$OCH_3$ | $C_{16}H_{33}$— | $CH_3$— | H | 102 |
| 12 | 4-$OCH_3$ | $C_{16}H_{33}$— | $CH_3$— | Cl | 67 |
| 13 | 4-$OCH_3$ | $C_{16}H_{33}$— | $CH_3$— | T* | about 50 |
| 14 | 4-$OCH_3$ | $CH_2$—$CH_2$—$OC_6H_3$ (2,4-t-$C_5H_{11}$)$_2$ | $CH_3$— | H | 112 |
| 15 | 4-$OCH_3$ | $CH_2$—$CH_2$—$OC_6H_3$ (2,4-t-$C_5H_{11}$)$_2$ | $CH_3$— | Cl | 110 |
| 16 | 4-$OCH_3$ | $CH_2$—$CH_2$—$OC_6H_3$ (2,4-t-$C_5H_{11}$)$_2$ | $CH_3$— | T* | 94 |
| 17 | 4-$OCH_2$—$CH_2$—$C_6H_3$(2,4-t-$C_5H_{11}$)$_2$ | $CH_3$— | $CH_3$— | H | 126 |
| 18 | " | $CH_3$— | $CH_3$— | Cl | oil |
| 19 | " | $CH_3$— | $CH_3$— | T* | 124 |
| 20 | 4-$OCH_3$ | $C_6H_3$(2,4-t-$C_5H_{11}$)$_2$ | $CH_3$— | H | 98 |
| 21 | 4-$OCH_3$ | " | $CH_3$— | Cl | 115 |
| 22 | 4-$OCH_3$ | " | $CH_3$— | T* | about 110 |
| 23 | 3-NHCOCH($C_2H_5$)<br>\|<br>$OC_6H_5$2,4-di-t-$C_5H_{11}$ | $CH_3$— | $CH_3$— | H | oil |
| 24 | " | $CH_3$— | $CH_3$— | Cl | 110 |
| 25 | " | $CH_3$— | $CH_3$— | T* | 110 |
| 26 | 4-NHCOCH—$C_2H_5$<br>\|<br>$OC_6H_3$(2,4-di-t-$C_5H_{11}$ | $CH_3$— | $CH_3$— | H | about 70 |
| 27 | " | $CH_3$— | $CH_3$— | Cl | <50 |
| 28 | " | $CH_3$— | $CH_3$— | T* | 130 |
| 29 | 2-$OC_{16}H_{33}$ | $CH_3$— | $CH_3$— | H | 69 |
| 30 | " | $CH_3$— | $CH_3$— | Cl | 58 |
| 31 | " | $CH_3$— | $CH_3$— | T* | 87 |

Table B

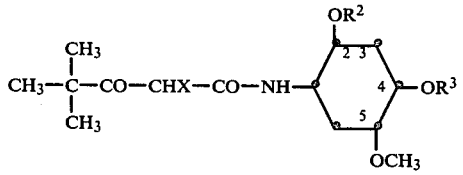

| no. of colour forming compound | $R^2$ | $R^3$ | X | Melting point °C. |
|---|---|---|---|---|
| 32 | $CH_2$—$CH_2OC_6H_3$ 2,4-di-t-$C_5H_{11}$ | $CH_3$ | H | 92 |
| 33 | " | $CH_3$ | Cl | 127 |
| 34 | " | $CH_3$ | T* | 186 |

T* =

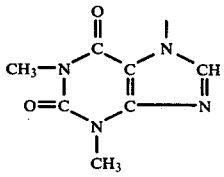

The following preparations illustrate how the colour couplers according to the present invention can be prepared.

Preparation of colour coupler 1

A solution of 39.3 g (0.1 mole) of 2,5-dimethoxy-4-hexadecyloxy-aniline and 25.7 g (0.11 mole) of 4-methoxybenzoylacetic acid ethylester in 120 ml of xylene was refluxed for 1 h, while distilling off the ethanol formed. After cooling the precipitate formed was filtered off, stirred with methanol and dried. Yield: 41 g (72%). Melting point: 99° C.

Preparation of colour coupler 2

To a solution of 28.45 g (0.05 mole) of colour coupler 1 in 150 ml of dichloromethane, 4.5 ml (0.055 mole) of sulphuryl chloride were added dropwise. After stirring for 1 h at a temperature of about 20° C., 5 ml of methanol were added and the mixture was evaporated until dryness. The residue was recrystallized from hexane. Yield: 21 g (70%). Melting point: 84° C.

Preparation of colour coupler 3

To a solution of 5.94 g (0.033 mole) of theophylline in 75 ml of acetonitrile and 8.25 ml (0.066 mole) of tetramethylguanidine, 19.9 g (0.033 mole) of colour coupler 2 were added. After 30 min the precipitate formed, was filtered off and stirred in HCl 1 N.

The product was extracted with dichloromethane. The extract was washed until neutral with water, dried and evaporated. The residue was recrystallized from ethanol. Yield: 50%. Melting point: 98° C.

Preparation of colour coupler 4

A mixture of 164.7 g (0.9 mole) of 2,4,5-trimethoxyaniline and 411.5 g (0.9 mole) of 4-hexadecyloxybenzoylacetic acid methylester in 675 ml of dry xylene was boiled while continuously distilling off methanol. After 2 h the solution was cooled and diluted with 1.5 l of methanol. The precipitate formed was filtered off, washed with 2 l of hexane and was dried. Yield: 434 g (84%). Melting point: 102° C.

Preparation of colour coupler 5

To a solution of 398.3 g (0.7 mole) of the above described colour coupler 4 in 2 l of dichloromethane, 59.5 ml (0.735 mole) of sulphuryl chloride were added dropwise over a period of 30 min. After stirring for another hour 20 ml of methanol were added and the solution was evaporated until dryness.

The oily residue was stirred in 500 ml of methanol and the precipitate which formed, was filtered off. The product was washed 2 times with 100 ml of methanol whereupon it was dried. Yield: 386 g (91%). Melting point: 90° C.

Preparation of colour coupler 6

To a hot solution (65° C.) of 191 g (0.3 mole) of colour coupler 5 in 420 ml of acetonitrile, a solution of 54 g (0.3 mole) of theophylline in 200 ml of acetonitrile and 50 ml of tetramethylguanidine were added in 5 min. Stirring of the reaction mixture occurred during 1 h, without any further heating. The reaction mixture was acidified with 20 ml of concentrated hydrochloric acid and was diluted with 500 ml of water. The precipitate formed was filtered off, stirred with water, filtered off again and recrystallized from acetonitrile. Yield: 138 g (95%). Melting point: 129° C.

Preparation of colour coupler 7

To a solution of 10.2 g (0.067 mole) of 4-methoxycarbonylphenol in 120 ml of acetonitrile and 10 ml of tetramethylguanidine 40.5 g (0.067 mole) of colour coupler 5 was added. After 2 h at 70° C. the cooled solution (20° C.) was acidified with 4.5 ml of concentrated hydrochloric acid and then diluted with 100 ml of water. The precipitate formed was filtered off and after it was dried, recrystallized from isopropylether. Yield: 18 g (37%). Melting point: 110° C.

If in the preparation of the starting materials for the preparation of the colour couplers of the present invention the dialkoxydinitrobenzene compound is allowed to react with a dihydroxy or polyhydroxy compound e.g. ethylene glycol, polyethylene glycol, xylene diol etc. colour formers can be obtained which can be represented by the formulae:

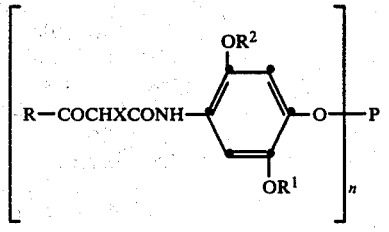

-continued
and

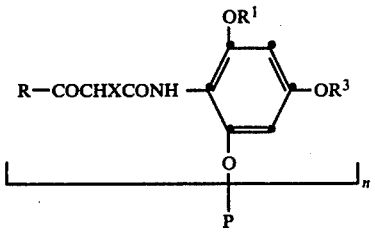

wherein

R, X, $R^1$, $R^2$ and $R^3$ are as defined hereinbefore n is an integer of at least 1, and preferably 2

P is the residue of a di- or polyhydroxy compound in which all or part of the hydroxy-hydrogen atoms are replaced by the dialkoxyanilide derivative.

Although the invention is particularly concerned with non-diffusible colour couplers for use in a photographic element, the colour couplers according to the invention can also be of the diffusible type for use in developer solutions.

The present invention thus provides a method of producing photographic colour images by exposure and development with an aromatic primary amino colour developing agent of a photographic silver halide material wherein development occurs in the presence of a colour coupler as defined herein, which may be present in the developer or in the material.

The present invention also provides a photographic material comprising at least one silver halide emulsion layer and a colour coupler as defined herein. For use in the material itself the colour couplers are non-diffusible. For this purpose the colour couplers are provided in the acyl and/or anilide part of the molecule with one or more ballasting groups having an aliphatic straight-chain or branched-chain hydrocarbon group of at least 5 C-atoms.

In photographic colour elements, the colour couplers are preferably incorporated into a silver halide emulsion layer, but they may also be used in a hydrophilic colloid layer situated at the same side of the support as the light-sensitive emulsion layer and preferably adjacent to said light-sensitive layer.

The colour couplers of the present invention may be used together with other colour couplers, in one or more light-sensitive layers sensitive to the same wavelength range.

The colour couplers can be incorporated into hydrophilic colloid compositions according to any of the prior art methods for incorporating photographic ingredients in hydrophilic colloid media.

It is preferred to dissolve the colour couplers in a water-immiscible low-boiling solvent e.g. ethyl acetate, methylene chloride, diethyl carbonate, chloroform, etc. and/or in a water-immiscible high-boiling solvent e.g. di-n-butylphthalate, tricresyl phosphate or a polyhalogenocarbonate-acetal of the type described in the published German Patent Application No. 2,613,504 and to disperse the solutions in extremely fine droplets, preferably in the presence of one or more wetting or dispersing agents into the hydrophilic colloid medium, e.g. aqueous gelatin, or into water, the low-boiling sparingly water-miscible solvent then being removed by evaporation. The stable dispersions of the colour couplers can be stored as such and then admixed whenever desired with the coating composition itself of the hydrophilic colloid layer such as a silver halide emulsion layer into which the compounds are intended to be present.

More details about particularly suitable techniques that may be employed for incorporating the colour couplers of the invention into a hydrophilic colloid layer of a photographic material can be found in U.S. Pat. Nos. 2,269,158; 2,284,887; 2,304,939; 2,304,940; 2,322,027; 3,689,271; 3,764,336 and 3,765,897; United Kingdom Patent Nos. 791,219; 1,098,594; 1,099,414; 1,099,415; 1,099,416; 1,099,417; 1,218,190; 1,272,561; 1,297,347 and 1,297,947, French Patent No. 1,555,663, Belgian Patent No. 722,026, German Patent No. 1,127,714, and the published German Pat. application No. 2,613,504.

The couplers according to the invention may be used in conjunction with various kinds of photographic emulsions. Various silver salts may be used as the sensitive salt such as silver bromide, silver iodide, silver chloride or mixed silver halides such as silver chlorobromide, silver chloroiodide, silver bromoiodide and silver chlorobromoiodide. The couplers can be used in emulsions of the mixed packet type as described in U.S. Pat. No. 2,698,794 or emulsions of the mixed grain type as described in U.S. Pat. No. 2,592,243. The colour couplers can be used with emulsions wherein latent images are formed predominantly on the surface of the silver halide crystal, or with emulsions wherein latent images are formed predominantly inside the silver halide crystal. They can also be used in colour diffusion transfer processes and elements.

The hydrophilic colloid used as the vehicle for the silver halide may be e.g., gelatin, colloidal albumin, zein, casein, a cellulose derivative, a synthetic hydrophilic colloid such as polyvinyl alcohol, poly-N-vinylpyrrolidone, etc., gelatin being preferred, however. If desired, compatible mixtures of two or more of these colloids may be employed for dispersing the silver halide.

The light-sensitive silver halide emulsions of use in the preparation of a photographic material according to the present invention may be chemically as well as optically sensitized.

They may be chemically sensitized by effecting the ripening in the presence of small amounts of sulphur containing compounds such as alkylthiocyanate, alkyl thiourea, sodium thiosulphate, the dithioocamide compounds disclosed in U.S. Pat. No. 3,501,313; by means of reductors e.g. tin compounds as described in French Patent No. 568,687, iminoamino methane sulphinic acid compounds as described in United Kingdom Pat. No. 789,813 and by means of small amounts of noble metal compounds such as gold, platinum, palladium, iridium, ruthenium and rhodium compounds as described in Z. Wiss. Phot. 46, 65–72 (1951) by R. Koslowsky. Combinations of these sensitizers may also be used. Chemical sensitization may be effected also in the presence of sulphinic acids e.g. toluene sulphinic acid.

The said emulsions may also comprise compounds that sensitize the emulsions by development acceleration e.g. compounds of the polyoxyalkylene type such as alkylene oxide condensation products as described among others in U.S. Pat. No. 2,531,832; 2,533,990; 3,210,191 and 3,158,484; in United Kingdom Patent Specifications 920,637 and 991,608 and in Belgian Patent Specification 648,710, onium derivatives of amino-N-oxides as described in United Kingdom Pat. No. 1,121,696, compounds of the type described in U.S. Pat. No. 3,523,796; 3,523,797; 3,552,968; 3,746,545 and 3,749,574; thioether compounds as described in the published German Pat. application Nos. 2,630,878; 2,601,778; 2,601,779 and 2,601,814, in U.S. Pat. Nos. 3,046,129; 3,046,132; 3,046,133; 3,046,134; 3,046,135 and 3,201,242, in United Kingdom Pat. Nos. 931,018 and 1,249,248 and in French Pat. No. 1,351,410.

Further, the emulsions may comprise antifoggants, stabilizers e.g. heterocyclic nitrogen-containing thioxo compounds such as benzothiazoline-2-thione and 1-phenyl-2-tetrazoline-5-thione and compounds of the hydroxytriazolopyrimidine type (cfr. Birr, Z. Wiss. Photogr. Photophys. Photochem., Vol. 47 (1952), 2–58). They can also be stabilized with mercury compounds such as the mercury compounds described in Belgian Patent Nos. 524,121; 677,337 and 707,386 and in U.S. Pat. No. 3,179,520. Other suitable antifoggants for use in colour emulsions comprising the colour couplers of the invention are the aromatic disulphides as described in United Kingdom Pat. No. 1,328,806 and the nitrobenzene compounds of the type described in Belgian Pat. No. 788,687.

The light-sensitive emulsion layers and adjacent layers may comprise any other kind of ingredients such as plasticizers, hardening agents, stabilizing agents, wetting agents, etc. Examples of suitable hardening agents are formaldehyde, halogen-substituted aldehydes containing a carboxyl group e.g. mucobromic and mucochloric acid, diketones, dialdehydes, methane sulphonic acid esters, etc., halogen substituted triazines e.g. 2,4-dichloro-6-hydroxy-s-triazine, carbodiimines as described in U.S. Pat. Nos. 2,938,892 and 3,098,693, dihydroquinolines as described in published German Pat. application No. (DE-OS) 2,332,317, carbamoylpyrimidiniums as described in published German Pat. application Nos. (DE-OS) 2,225,230 and 2,317,677 and carbamoyloxypyrimidiniums as described in published German Pat. application (DE-OS) No. 2,408,814.

The non-diffusing colour couplers described in the present invention are usually incorporated into one of the differently spectrally sensitive silver halide emulsion layers of a photographic multilayer colour material, which includes positive, negative and reversal material. Such photographic multilayer colour material usually comprises a support, a red-sensitized silver halide emulsion layer with a cyan-forming colour coupler, a green-sensitized silver halide emulsion layer with a magenta-forming colour coupler and a blue-sensitive silver halide emulsion layer with a yellow-forming colour coupler. These colour materials may further comprise one or more intermediate layers, filter layers and protective surface layers. An antihalation layer may be provided between the emulsion layers and the support or at the other side of the support. An antihalation layer at the side of the support opposite to that carrying the emulsion layers is preferably removed by processing. It is preferred to provide between the support and the antihalation layer an intermediate layer comprising a different or preferably a same soluble binder. Suitable binders for both layers are copolymers of (meth)acrylates and (meth)acrylic acids as described in British Pat. Nos. 575,512; 633,936 and 1,338,900 and in U.S. Pat. No. 3,113,867 e.g. copoly(methylmethacrylate/ethylacrylate/methacrylic acid) (30/50/20).

The multilayer photographic element may comprise for the formation of each of the three colour separation images more than one, e.g. two silver halide emulsion layers of different speed and comprising the same or different colour couplers including 2-equivalent and 4-equivalent colour couplers.

Colour couplers of different coupling activity may be comprised in one or more layers for the formation of the same colour separation image. The photographic element may comprise one or more free competing couplers to improve colour reproduction by colourless coupling with oxidized developer agent in areas where these oxidation products should be rendered ineffective so that the degradation of the image is inhibited.

The emulsions can be coated on a wide variety of photographic emulsion supports. Typical supports include cellulose ester film, polyvinylacetal film, polystyrene film, polyethylene terephthalate film and related films of resinous materials, as well as paper and glass. It is also possible to employ paper coated with α-olefin polymers e.g. paper coated with polyethylene, polypropylene, ethylenebutylene copolymers, etc.

For the production of photographic colour images according to the present invention an exposed silver halide emulsion layer is developed with an aromatic primary amino developing substance in the presence of a colour coupler according to the present invention. All colour developing agents capable of forming azomethine dyes can be utilised as developers. Suitable developing agents are aromatic compounds such as p-phenylenediamine and derivatives for example N,N-diethyl-p-phenylenediamine, N-butyl-N-sulphobutyl-p-phenylenediamine, 2-amino-5-diethylaminotoluene hydrochloride, 4-amino-N-ethyl-N(β-methanesulphonamidoethyl)-m-toluidine, N-hydroxyethyl-N-ethyl-p-phenylenediamine, 2-amino-5[N-ethyl-N(β-methylsulphonylamino)ethyl]aminotoluene sulphate, 4-amino-3-methyl-N-ethyl-N(β-hydroxyethyl)-aniline sulphate, N-ethyl-N-methoxyethyl-3-methyl-p-phenylene diamine, N-ethyl-N-ethoxyethyl-3-methyl-p-phenylene diamine, etc. Further suitable colour developers are described in J. Am. Chem. Soc. 73, 3100–3125 (1951).

The developing compositions may comprise the usual ingredients as well as development activating compounds including polyoxyethylene compounds, onium compounds and organic thioethers as referred to hereinbefore, antifoggants e.g. nitrobenzene compounds of the type described in the Belgian Patent No. 788,687, etc.

The following examples illustrate the present invention.

EXAMPLE 1

The colour couplers listed in the following table were incorporated into a conventional silver iodobromide (2.3 mole % of iodide) emulsion in an amount of about 0.006 mmole of coupler per mole of silver halide.

The couplers were incorporated from aqueous gelatin dispersions obtained by dissolving the couplers in ethyl acetate, dispersing the solution in aqueous gelatin and removing the ethyl acetate by evaporation under reduced pressure.

The emulsion portions were coated on a conventional film support, dried and overcoated with a gelatin antistress layer. After having been dried, the emulsions were exposed through a stepwedge and processed in a conventional way comprising development in a developer based on one of the colour developing agents listed in the table, bleaching and fixing.

The colour developing agents referred to in the table are:

A = 2-amino-5-diethylamino-toluene hydrochloride

B = 2-amino-5-[N-ethyl-N(β-methylsulphonylamino)ethyl] aminotoluene sulphate

C = 4-amino-3-methyl-N-ethyl-N-(β-hydroxyethyl-)aniline sulphate

D = N,N-diethyl-p-phenylenediamine.

Yellow coloured wedge images were obtained. As is apparent from the results listed in the following table, the couplers of the present invention have superior light-stability as compared with corresponding yellow colour couplers carrying two alkoxy groups in the 2- and 5-position of the phenyl nucleus of the anilide part of an acylacetanilide coupler and no substituent or an electronegative substituent in the 4-position e.g. chlorine, sulphamoyl and acylamino.

For determining the light-stability, the loss in yellow density is measured at density 0.5 and 1.5 of the wedge after having been exposed for 15 hours to a 1500 Watt Xenon lamp in a XENOTEST 150-apparatus of "Original Hanau-Quartslampen GmbH" Hanau am Main, Germany. The loss in density is given in the table on a percentage basis.

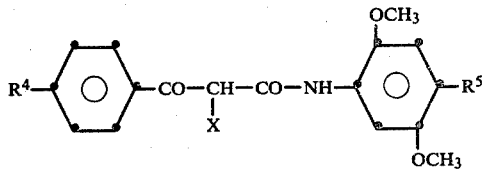

0

| no. of colour forming coupler | | $R^5$ | $R^4$ | colour developing agent: D, percentage density loss at D = 0.5 | D, D = 1.5 | C, D = 0.5 | C, D = 1.5 | B, D = 0.5 | B, D = 1.5 | A, D = 0.5 | A, D = 1.5 |
|---|---|---|---|---|---|---|---|---|---|---|---|
| 6 | T(1) | $OCH_3$ | $OC_{16}H_{33}$ | 24 | 15 | 29 | 24 | 8 | 12 | 20 | 19 |
| comp. coupler | " | H | " | 34 | 24 | 44 | 35 | 23 | 21 | 42 | 32 |
| comp. coupler | " | $SO_2N(CH_3)_2$ | " | 46 | 27 | (5) | (5) | 34 | 22 | 32 | 19 |
| comp. coupler | " | Cl | " | 26 | 18 | 40 | 20 | 20 | 12 | 38 | 30 |

-continued

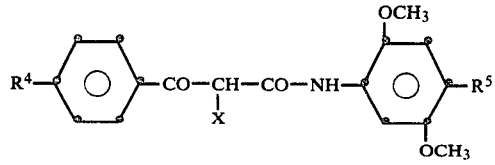

0

| no. of colour forming coupler | | $R^5$ | $R^4$ | colour developing agent D percentage density loss at D = 0.5 | D = 1.5 | C percentage density loss at D = 0.5 | D = 1.5 | B percentage density loss at D = 0.5 | D = 1.5 | A percentage density loss at D = 0.5 | D = 1.5 |
|---|---|---|---|---|---|---|---|---|---|---|---|
| comp. coupler | " | $SO_2N(CH_3)C_{16}H_{33}$ | $OCH_3$ | 46 | 27 | 42 | 23 | 34 | 18 | 40 | 26 |
| 7 | F(2) | $OCH_3$ | $OC_{16}H_{33}$ | 24 | 18 | 39 | 31 | 24 | 19 | 30 | 30 |
| comp. coupler | F | H | " | 36 | 34 | 54 | 47 | 37 | 23 | 50 | 45 |
| 4 | H | $OCH_3$ | " | 30 | 15 | 40 | 30 | 18 | 5 | 24 | 14 |
| comp. coupler | H | Cl | $OC_{16}H_{33}$ | 50 | 41 | 54 | 61 | 46 | 34 | 50 | 51 |
| comp. coupler | H | $SO_2N(CH_3)_2$ | " | 44 | 26 | (5) | (5) | 32 | 18 | 36 | 21 |
| comp. coupler | H | $SO_2N(CH_3)C_{16}H_{33}$ | $OCH_3$ | 42 | 25 | 42 | 17 | 32 | 14 | 36 | 16 |
| comp. coupler | H | (3) | $OCH_3$ | 48 | 36 | (5) | (5) | 28 | 16 | 40 | 21 |
| comp. coupler | H | (4) | $OCH_3$ | 48 | 30 | (5) | (5) | 28 | 16 | 40 | 20 |

(1) =

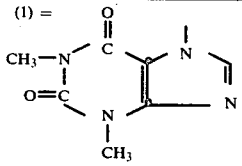

(2) = 4-$CH_3$—OOC—$C_6H_4$O—

(3) =

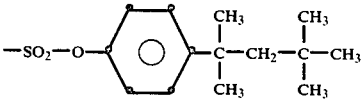

(4) =

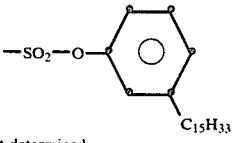

(5) not determined.

EXAMPLE 2

In order to demonstrate the differences in sensitometric behaviour (gradation and maximum density) of the colour couplers of the present invention with corresponding compounds whereof the 4 position relative to the amide link of the phenyl nucleus of the anilide parts is unsubstituted, Example 1 is repeated and colour couplers as mentioned in this following table were used.

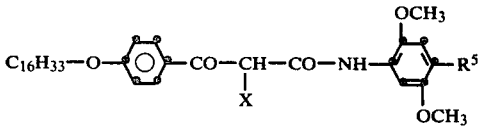

| Indentification of the compound | $R^5$ | x (1) | Colour developing agents (2) D γ | D max D | C γ | C max D | B γ | B max D |
|---|---|---|---|---|---|---|---|---|
| Comparison | H | T | 1.8 | 2.71 | 1.6 | 2.45 | 2.1 | 2.58 |
| Coupler 6 of table A | $CH_3O$ | T | 1.8 | 2.76 | 1.7 | 2.65 | 2.3 | 2.69 |
| Comparison | H | F | 0.9 | 1.25 | 0.7 | 1.16 | 1.1 | 1.34 |
| Coupler 7 of table A | $CH_3O$ | F | 1.3 | 2.56 | 1.3 | 2.17 | 1.8 | 2.45 |
| Comparison | H | H | 0.2 | 0.58 | (3) | 0.20 | (3) | (3) |
| Coupler 4 of | $CH_3O$ | H | 0.6 | 1.54 | 0.6 | 1.33 | 1.2 | 2.10 |

-continued

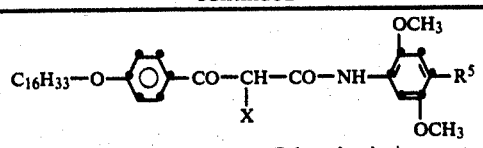

| Indentification of the compound | $R^5$ | x (1) | Colour developing agents (2) D γ | D max D | C γ | C max D | B γ | B max D |
|---|---|---|---|---|---|---|---|---|
| table A | | | | | | | | |

(1) and (2): see example 1
(3): too low, cannot be measured.

From the results mentioned in the above table it is clear that gradation is increased and the maximum density also shows an increased value, when the phenyl nucleus of the anilide part of colour coupler molecule carries 3 alkoxy groups instead of 2 alkoxy groups.

We claim:

1. A method of producing a yellow coloured photographic image in a photographic light-sensitive silver halide material by image-wise exposure of the material and development thereof by means of an aromatic primary amino colour developing agent in the presence of an acylacetanilide compound suitable for use as yellow-forming colour coupler in silver halide colour photography characterized in that the acylacetanilide is one whereof the phenyl nucleus of the anilide group of the molecule carries oxyhydrocarbon groups in the 2-, 4- and 5-positions with respect to the amido group.

2. A method according to claim 1, wherein the phenyl nucleus of the anilide group of the molecule of the colour coupler contains, relative to the amide link, in the 5-position a $C_1$–$C_5$ alkoxy group and in the 2- and 4-positions an alkoxy group including a substituted alkoxy group or an aryloxy group including a substituted aryloxy group, at least one of the 2- and 4-positions carrying a $C_1$–$C_5$ alkoxy group.

3. A method according to claim 1, wherein the colour coupler is a benzoyl or pivaloyl acetanilide colour coupler.

4. A method according to claim 2, wherein the colour coupler can be represented by the following general formula:

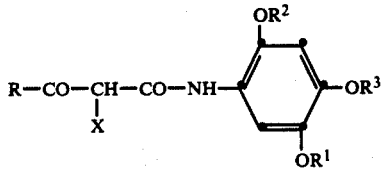

wherein R represents alkyl or phenyl including substituted phenyl, $R^1$ is $C_1$–$C_5$ alkyl, each of $R^2$ and $R^3$ may represent a $C_1$–$C_{20}$ alkoxy group including a substituted $C_1$–$C_{20}$ alkyl group or an aryl group including a substituted aryl group at least one of $R^2$ and $R^3$ being a $C_1$–$C_5$ alkyl, and X represents a hydrogen atom or substituent that exhibits two equivalent character on colour development, preferably a halogen atom, a —S—R′ group wherein R′ is alkyl, substituted alkyl, aryl, substituted aryl, or a heterocycle or substituted heterocycle, a —O—R″ group wherein R″ is alkyl, substituted alkyl, aryl, substituted aryl, a heterocycle or acyl, or a 5- or 6-membered N-containing saturated or unsaturated heterocycle.

5. A photographic element comprising at least one silver halide emulsion layer and an acylacetanilide colour coupler wherein the colour coupler is one whereof the phenyl nucleus of the anilide group of the molecule carries oxyhydrocarbon groups in the 2-, 4- and 5-positions with respect to the amido group.

6. A photographic element according to claim 5, wherein the phenyl nucleus of the anilide group of the molecule of the colour coupler contains, relative to the amide link, in the 5-position a $C_1$–$C_5$ alkoxy group and in the 2- and 4-positions an alkoxy group including a substituted alkoxy group or an aryloxy group including a substituted aryloxy group, at least one of the 2- and 4-positions carrying a $C_1$–$C_5$ alkoxy group.

7. A photographic element according to claim 5, wherein the colour coupler is a benzoyl or pivaloyl acetanilide colour coupler.

8. A photographic element according to claim 5, wherein the colour coupler can be represented by the following general formula:

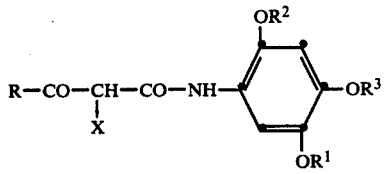

wherein R represents alkyl or phenyl including substituted phenyl, $R^1$ is $C_1$–$C_5$ alkyl, each of $R^2$ and $R^3$ may represent a $C_1$–$C_{20}$ alkyl group including a substituted $C_1$–$C_{20}$ alkyl group or an aryl group including a substituted aryl group at least one of $R^2$ and $R^3$ being a $C_1$–$C_5$ alkyl, and X represents a hydrogen atom or substituent that exhibits two equivalent character on colour development, preferably a halogen atom, a —S—R′ group wherein R′ is alkyl, substituted alkyl, aryl, substituted aryl, or a heterocycle or substituted heterocycle, a —O—R″ group wherein R″ is alkyl, substituted alkyl, aryl, substituted aryl, a heterocycle or acyl, or a 5- or 6-membered N-containing saturated or unsaturated heterocycle.

* * * * *

UNITED STATES PATENT AND TRADEMARK OFFICE

CERTIFICATE OF CORRECTION

PATENT NO. : 4,201,584

DATED : May 6, 1980

INVENTOR(S) : Marcel J. Monbaliu et al

It is certified that error appears in the above-identified patent and that said Letters Patent is hereby corrected as shown below:

Column 3, line 44, "1,800,402" should read --1,800,420--;

Column 17, Claim 4, line 58, "$C_1$-$C_{20}$ alkoxy" should read --$C_1$-$C_{20}$ alkyl--.

Signed and Sealed this

Fourth Day of October 1983

[SEAL]

*Attest:*

GERALD J. MOSSINGHOFF

*Attesting Officer*

*Commissioner of Patents and Trademarks*